US011198580B2

(12) United States Patent
Ruiz et al.

(10) Patent No.: US 11,198,580 B2
(45) Date of Patent: Dec. 14, 2021

(54) STACKING MODULE WITH AIR STREAMS

(71) Applicant: Xerox Corporation, Norwalk, CT (US)

(72) Inventors: Erwin Ruiz, Rochester, NY (US); Carlos M. Terrero, Ontario, NY (US); Roberto A. Irizarry, Rochester, NY (US); Glenn David Batchelor, Fairport, NY (US); Rachel Lynn Tanchak, Rochester, NY (US)

(73) Assignee: XEROX CORPORATION, Norwalk, CT (US)

( * ) Notice: Subject to any disclaimer, the term of this patent is extended or adjusted under 35 U.S.C. 154(b) by 171 days.

(21) Appl. No.: 16/563,543

(22) Filed: Sep. 6, 2019

(65) Prior Publication Data

US 2021/0070578 A1 Mar. 11, 2021

(51) Int. Cl.

| | |
|---|---|
| ***B65H 29/24*** | (2006.01) |
| ***B65H 29/22*** | (2006.01) |
| ***B65H 29/18*** | (2006.01) |
| ***B65H 29/40*** | (2006.01) |

(52) U.S. Cl.

CPC ..... *B65H 29/246* (2013.01); *B65H 29/18* (2013.01); *B65H 29/22* (2013.01); *B65H 29/248* (2013.01); *B65H 29/40* (2013.01); *B65H 2404/1114* (2013.01); *B65H 2801/06* (2013.01)

(58) Field of Classification Search

CPC ..... B65H 29/246; B65H 29/22; B65H 29/18; B65H 29/40; B65H 2404/1114

See application file for complete search history.

(56) References Cited

U.S. PATENT DOCUMENTS

| | | | | |
|---|---|---|---|---|
| 3,971,554 | A | 7/1976 | Stange | |
| 4,073,487 | A | 2/1978 | Schirrmeister et al. | |
| 4,310,152 | A | 1/1982 | Mitzel | |
| 4,466,605 | A | 8/1984 | Leuthold et al. | |
| 5,671,920 | A | 9/1997 | Acquaviva et al. | |
| 5,951,006 | A | 9/1999 | Biegelsen et al. | |
| 6,091,929 | A | 7/2000 | Yamazaki et al. | |
| 6,846,151 | B2 | 1/2005 | Mayerberg, II et al. | |
| 7,140,828 | B2 | 11/2006 | Mayerberg, II et al. | |
| 8,403,323 | B2 | 3/2013 | Rutten et al. | |
| 8,424,875 | B2 | 4/2013 | Heise et al. | |
| 8,651,483 | B2 | 2/2014 | Albers et al. | |
| 9,120,634 | B1 * | 9/2015 | Muir | B65H 5/066 |
| 9,758,334 | B1 | 9/2017 | Herrmann | |
| 9,821,978 | B2 | 11/2017 | Herrmann | |
| 10,005,632 | B1 * | 6/2018 | Ruiz | B65H 29/247 |
| 10,065,826 | B1 * | 9/2018 | Ruiz | B65H 7/02 |

(Continued)

*Primary Examiner* — Patrick Cicchino

(57) ABSTRACT

An apparatus is disclosed. For example, the apparatus includes a paper feed to feed print media a single sheet at a time, a plurality of rotating discs, wherein each one of the plurality of rotating discs comprises an elastomer ring to secure a leading edge of the single sheet against a registration wall and initiate a flipping process, a curved baffle positioned above the plurality of rotating discs and the single sheet, an air duct located above the plurality of rotating discs and the single sheet to force an air flow towards the curved baffle, wherein the air flow follows a shape of the curved baffle to create a low pressure zone above the single sheet to keep a trailing edge of the single sheet levitated during completion of the flipping process, and a movable platform to hold a stack of the print media.

18 Claims, 6 Drawing Sheets

(56) References Cited

U.S. PATENT DOCUMENTS

2005/0271448 A1* 12/2005 Shmaiser ..... B65H 29/08
400/624
2005/0280198 A1 12/2005 Laluk et al.

* cited by examiner

STACKING MODULE WITH AIR STREAMS

The present disclosure relates generally to printing devices and relates more particularly, to an improved stacking module with air streams.

BACKGROUND

Printers are used to print text, images, graphics, and the like on print media. The images are rendered for the printer. The print media is loaded through a print path of the printer to print the desired image onto the print media. The print media may travel through various processing areas in the printer and finishing modules to complete the print job. Different finishing modules may perform post print processing on the print media.

Customers are moving to thinner, lighter, and larger print media to save cost. However, the thinner, lighter, and larger print media can cause malfunctions (e.g., paper jams) in certain modules of the printer. For example, as the print media becomes lighter and larger, the print media may not have enough beam strength or stiffness for certain processing. The thinner and larger print media may also be more prone to wrinkles and ripples in high relative humidity. The wrinkles or ripples in the print media may also cause problems in certain modules of the printer.

SUMMARY

According to aspects illustrated herein, there are provided an apparatus and a method for flipping print media in stacker module. One disclosed feature of the embodiments is an apparatus comprising a paper feed to feed print media a single sheet at a time, a plurality of rotating discs, wherein each one of the plurality of rotating discs comprises an elastomer ring to secure a leading edge of the single sheet against a registration wall and initiate a flipping process, a curved baffle positioned above the plurality of rotating discs and the single sheet, an air duct located above the plurality of rotating discs and the single sheet to force an air flow towards the curved baffle, wherein the air flow follows a shape of the curved baffle to create a low pressure zone above the single sheet to keep a trailing edge of the single sheet levitated during completion of the flipping process, and a movable platform to hold a stack of the print media.

Another disclosed feature of the embodiments is a method for flipping print media in a stacker module. In one embodiment, the method activates a blower to generate an air flow while a valve is in a closed position, activates a paper feed to feed a single sheet of the print media in a stacker module, initiates a rotation of a plurality of rotating discs each having an elastomer ring to catch the single sheet of the print media to initiate a flipping process, receives a signal from a sensor that a leading edge of the single sheet is contacting a registration wall, and opens the valve in response to the leading edge of the single sheet being detected against the registration wall to force the air flow through an air duct towards a curved baffle positioned above the plurality of rotating discs and the single sheet to create a low pressure zone about the single sheet to keep a trailing edge of the single sheet levitated during completion of the flipping process.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

The present disclosure broadly discloses an improved stacking module with air streams assist. As discussed above, as customers desire to use thinner, lighter, and larger print media to save cost, the thinner, lighter, and larger print media can cause problems in certain modules of the printer. One example module is a stacking module that is used to flip and stack the print media. For example, as the print media becomes lighter and larger, the print media may not have enough beam strength or stiffness to flip on its own. As a result, print media may collapse on itself during the flipping process and create a jam in the stacking module. The thinner and larger print media may also be more prone to wrinkles and ripples in high relative humidity that can cause the stacker module to operate incorrectly or jam.

Embodiments of the present disclosure provide an improved stacking module that uses forced air to partially levitate the print media to allow the print media to complete the flipping process in the stacking module. The air may be generated by a blower and controlled by a valve and an air duct. The air may be provided at a high velocity around a curved baffle. The air flow may follow the Coanda effect to support the print media via the Bernoulli effect. The Coanda effect ensures that the air flow will follow the curve of the curved baffle. The Bernoulli effect may create a low pressure area above the print media and a high pressure area below the print media. As a result, the print media may maintain a proper shape and lift to prevent the print media from collapsing during the flipping process. As a result, lighter, thinner and larger print media may be used, even in relatively high humidity, without jamming the stacker module or causing the stacker module to malfunction.

Figure 1:
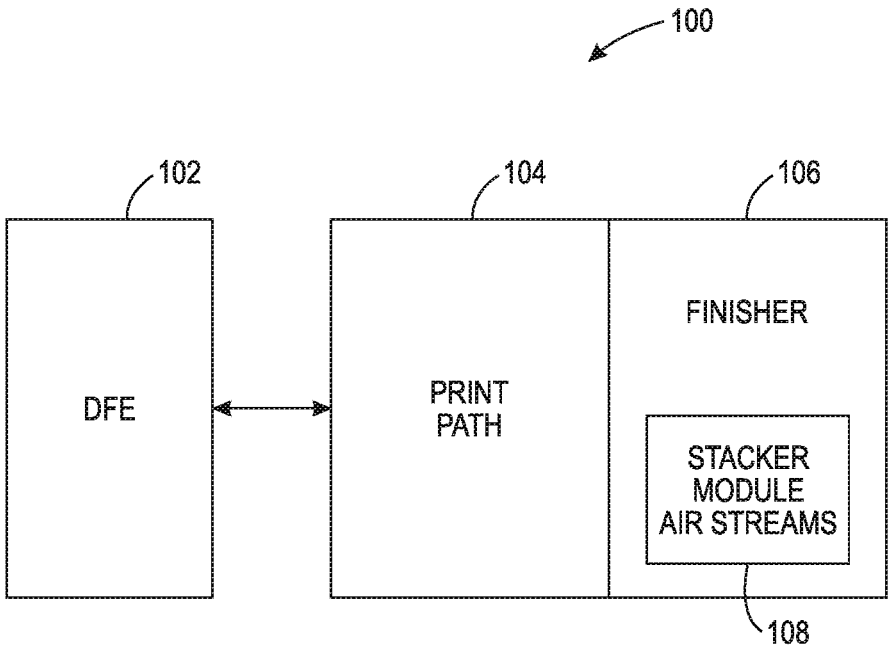
FIG. 1 illustrates a block diagram of an example printing device of the present disclosure.

FIG. 1 illustrates an example printer 100 that includes a stacker module 108 with air streams (also referred to simply as the stacker module 108) of the present disclosure. FIG. 1 illustrates a block diagram of the printer 100. In one example, the printer 100 may include a digital front end (DFE) 102. The DFE 102 may include a processor and a memory (e.g., a non-statutory computer readable medium). The processor of the DFE 102 may be in communication with control operations of components within a print path 104 and a finisher 106. The DFE 102 may process images and documents contained in print job requests to prepare the images or documents to be printed by the printer 100.

In one example, the print path 104 may include printing components such as toner, ink, a fuser, and the like (not shown), that perform the printing operations. The finisher 106 may include various different modules to perform finishing operations such as stapling, collating, stacking, and the like. In one example, the stacker module 108 may perform a flipping process and a stacking process.

It should be noted that FIG. 1 has been simplified for the ease of explanation of the present disclosure. The printer 100 may include additional components not shown in FIG. 1. For example, the printer 100 may include a user interface, networking components, additional paper trays, ink cartridges or toner cartridges, optical components (e.g., an optical scanner), and the like.

Figure 2:
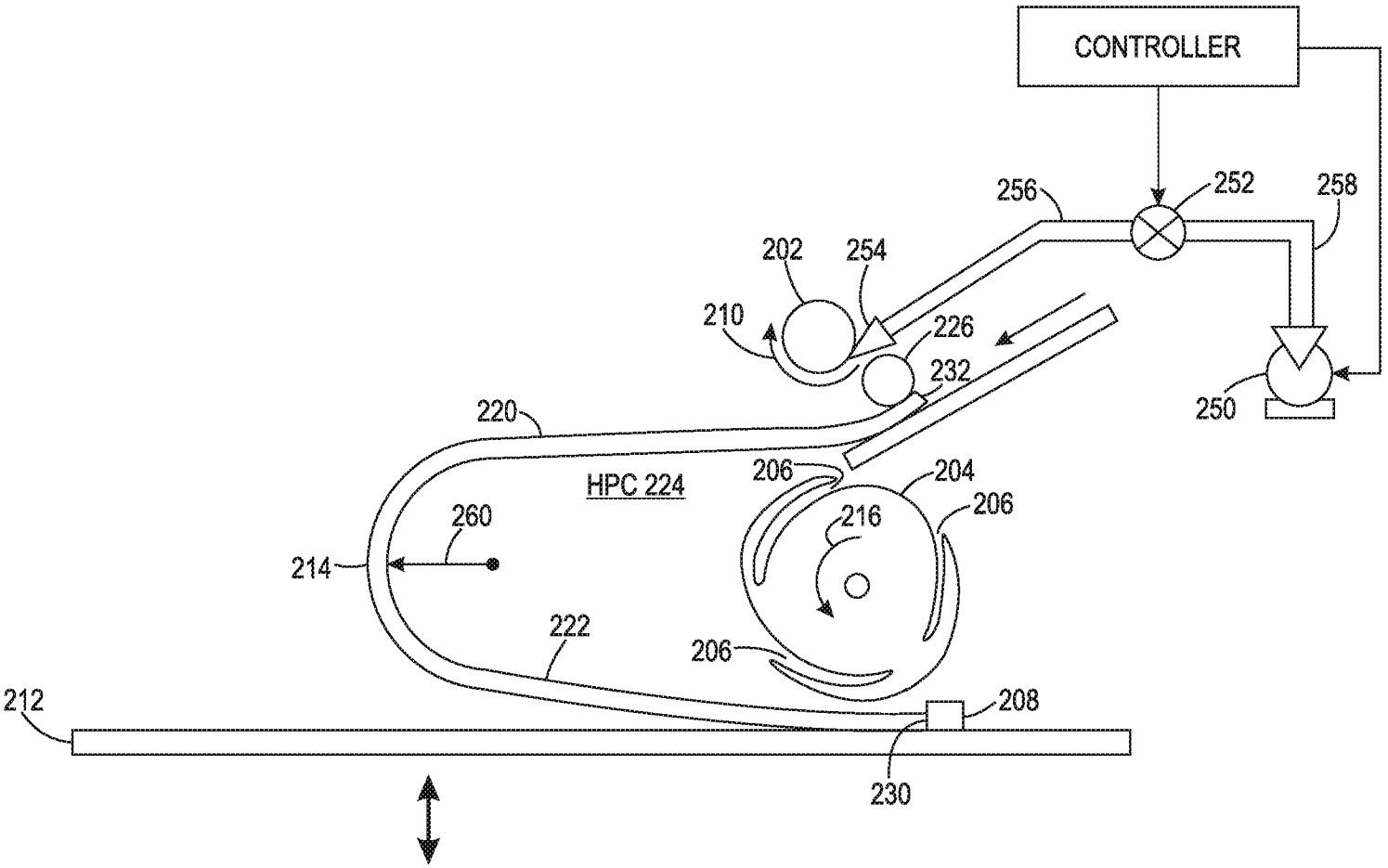
FIG. 2 illustrates a block diagram of a side view of an example stacker module with air streams of the present disclosure.

FIG. 2 illustrates a side view block diagram of an example of the stacker module 108. In one embodiment, a single sheet 214 of print media may be fed into the stacker module 108 one at a time as shown by an arrow to the right of a trailing edge 232 of the single sheet 214. The stacker module 108 may comprise a platform and a roller that moves the single sheet 214 of the print media into the stacker module 108.

The stacker module 108 may also include a paper feed 226. The paper feed 226 may catch a leading edge 230 of the single sheet 214 as the single sheet 214 is fed into the paper feed 226. A plurality of discs (or rotating discs) 204 may catch the leading edge 230 of the single sheet 214. For example, each one of the plurality of discs 204 may have an opening or slot 206 that catches the leading edge 230 of the single sheet 214. The opening 206 may include an elastomer ring near an outer edge to help "grip" the single sheet 214. As the plurality of discs 204 rotates, as shown by an arrow 216, the plurality of discs 204 may pull the leading edge 230 of the single sheet 180 degrees in a clockwise and/or a counterclockwise direction.

In one embodiment, the plurality of discs 204 may pull the leading edge 230 of the single sheet 214 towards a registration wall 208. The rotational force applied by the plurality of discs 204 may initiate a flipping process on the single sheet 214 of the print media as a trailing edge 232 of the single sheet 214 is ejected from the paper feed 226. The flipping process may flip the single sheet 214 along a length of the single sheet 214 onto the top of a stack of sheets.

In other words, the single sheet 214 may enter the stacker module with a first side facing up. After the flipping process is completed, the first side of the single sheet 214 may be in an opposite orientation, e.g., facing down, and now be the top sheet in the stack.

In previously designed stacker modules, the weight of the print media would be sufficient to flip the print media. However, as customers demand that the stacker modules be able to handle longer, thinner, and lighter print media, the currently designed stacker modules may not be able to handle the longer, thinner, and lighter print media. For example, longer, thinner, and lighter print media may not have enough beam strength or stiffness to flip on its own. As a result, the longer, thinner, and lighter print media may collapse without completing the flipping process. As a result, as subsequent sheets of print media enter the previously designed stacker module, a jam may occur as the longer, thinner, and lighter print media is unable to complete the flipping process.

In addition, the thinner and lighter the print media, the more adversely high relative humidity can affect the print media. For example, high relative humidity can cause wrinkles in the print media, which can lead to additional jams in the stacker module 108.

In one example, the single sheet 214 may be a longer, thinner and lighter print media. For example, the single sheet 214 of the print media of the present disclosure may have a weight that is less than 50 grams per square meter (gsm) and a length of less than 20 inches. In one example, the length may be greater than 17 inches and less than 20 inches. The length may be defined as a longest dimension of the single sheet 214 of the print media.

In one embodiment, a blower 250, a valve 252 and an air duct 254 may be installed in the stacker module 108. The blower 250 may generate air that may be forced through the valve 252 and the air duct 254. The blower 250 may be coupled to the valve 252 via an air flow coupling 258 (e.g., a pipe or a series of pipes). The valve 252 may be coupled to the air duct 254 via an air flow coupling 256 (e.g., a pipe or a series of pipes).

In one embodiment, the air duct 254 may be an air knife. The air knife may have a triangular cross-sectional shape and have openings along an edge. The air knife may be pressurized such that the air is forced through the openings at a high velocity.

In one embodiment, a curved baffle 202 may be located adjacent to the air duct 254. The curved baffle 202 may be a cylindrical rod in the stacker module 108, a semi-circular shape, or any other surface with a curved outer surface. Using the example of an air knife, the edge of the air knife with the openings may be located adjacent to an outer surface of the curved baffle. The air flow may be forced out of the openings of the air knife at a high velocity as air streams. Due to the Coanda effect, the air streams may follow the shape of the curved baffle 202 as shown by an arrow 210.

Due the Coanda effect, the air streams may follow around the curved baffle 202 rather than blowing the portion 220 down towards a movable platform 212. The high velocity of the air streams may also create a low pressure zone (LPZ) 218 above a portion 220 of the single sheet 214 and a high pressure zone (HPZ) 224 below the portion 220. Due to the Bernoulli effect, the LPZ 218 and the HPZ 224 may cause the portion 220 to levitate as the single sheet 214 is being flipped to maintain a flipping radius 260.

In one embodiment, a size of the openings may be a function of a size and weight of the single sheet 214 that is being flipped. For example, for larger sheets that require more force to maintain levitation during the flipping process, the holes may be smaller to increase the velocity of the air streams. In contrast, for smaller or lighter sheets, the holes may be larger to decrease the velocity of the air streams. In another embodiment, the holes may be a certain size and the pressure of the air streams may be increased or decreased by the blower 250.

In addition, no mechanical components are used to support the portion 220 of the single sheet 214 during the flipping processes. Rather, air streams are used to maintain the flipping radius 260. As a result, wrinkles or indentations that may cause jams may be prevented from forming in the single sheet 214.

In one embodiment, the air duct 254 may have a width (e.g., the dimension measured into the page in FIG. 2) that is approximately the same as a width of the movable platform 212. As a result, the air streams forced across the curved baffle 202 may blow evenly across a width of the single sheet 214 of the print media.

In one embodiment, the valve 252 may be an electromechanical valve that may be actuated by a controller 280 or a processor of the printer 100. The valve 252 may control the air flow that exits the air duct 254.

In one embodiment, the blower 250 may generate air flow that helps to levitate the portion 220 of the single sheet 214 that is near the trailing edge 232. For example, the blower 250 may be activated and the valve 252 may be opened to allow air to exit the air duct 254 towards the portion 220 of the single sheet 214. In one embodiment, the portion 220 may be defined as the half of the single sheet 214 that is closer to the trailing edge 232. Levitation of the portion 220 may increase the flipping radius 260. The larger the flipping radius 260, the more robust the flipping process may be against imperfections of the single sheet 214 of the print media (e.g., low beam strength, insufficient stiffness, wrinkles due to high relative humidity, formation of "dog ears," and the like).

Thus, the air flow may prevent the portion 220 from collapsing on top of a portion 222 that is near the leading edge 230 and resting on a movable platform 212. In one embodiment, the portion 222 may be defined as the half of the single sheet 214 that is closer to the leading edge 230. The air flow may help the single sheet 214 that is relatively long and light to complete the flipping process without collapsing on itself.

In one embodiment, the amount of air flow generated by the blower 250 may be a function of a weight and a length of the single sheet 214 of the print media. For example, the lighter and longer the single sheet 214 is, the greater the amount of air flow that should be generated. In addition, how long air streams are allowed to flow towards the curved baffle (e.g., via the controller 280 that controls operation of the blower 250 and the valve 252) may be a function of a length of the print media. For example, the longer the single sheet 214 is, the longer the valve 252 may be opened while the blower 250 is activated to keep the portion 220 levitated while the single sheet 214 is being fed through the stacker module 108.

In one embodiment, for the single sheet 214 that has a weight of approximately 45 gsm and a length of 17 inches, the amount of air flow that is generated may be approximately 15-20 cubic feet per minute (cfm).

In one embodiment, the blower 250 may be turned on during a cycle up when the stacker module 108 begins operation and the operation of the valve 252 may coincide with detection of each single sheet 214 that enters the stacker module 108 by a sensor in the paper path of the stacker module 108. To ensure that air is not being continuously blown out of the air duct that could interfere with the stacking operation, the valve 252 may be pulsed (e.g., turned off and on) based on a calculation of when the leading edge 230 contacts the registration wall 208. In one embodiment, the distance between the sensor and the registration wall 208 may be known as well as the speed that the single sheet 214 is moving. The same calculation may be used to detect when the trailing edge 232 exits the paper feed 226. Based on the calculations, the stacker module 108 may open the valve 252 to allow air from the blower 250 to pass and close the valve 252 after the trailing edge 232 has passed. The process may be repeated when a leading edge 230 of a subsequent single sheet 214 is detected against the registration wall 208. The blower 250 may be turned off after the last single sheet 214 is stacked.

Figure 3:
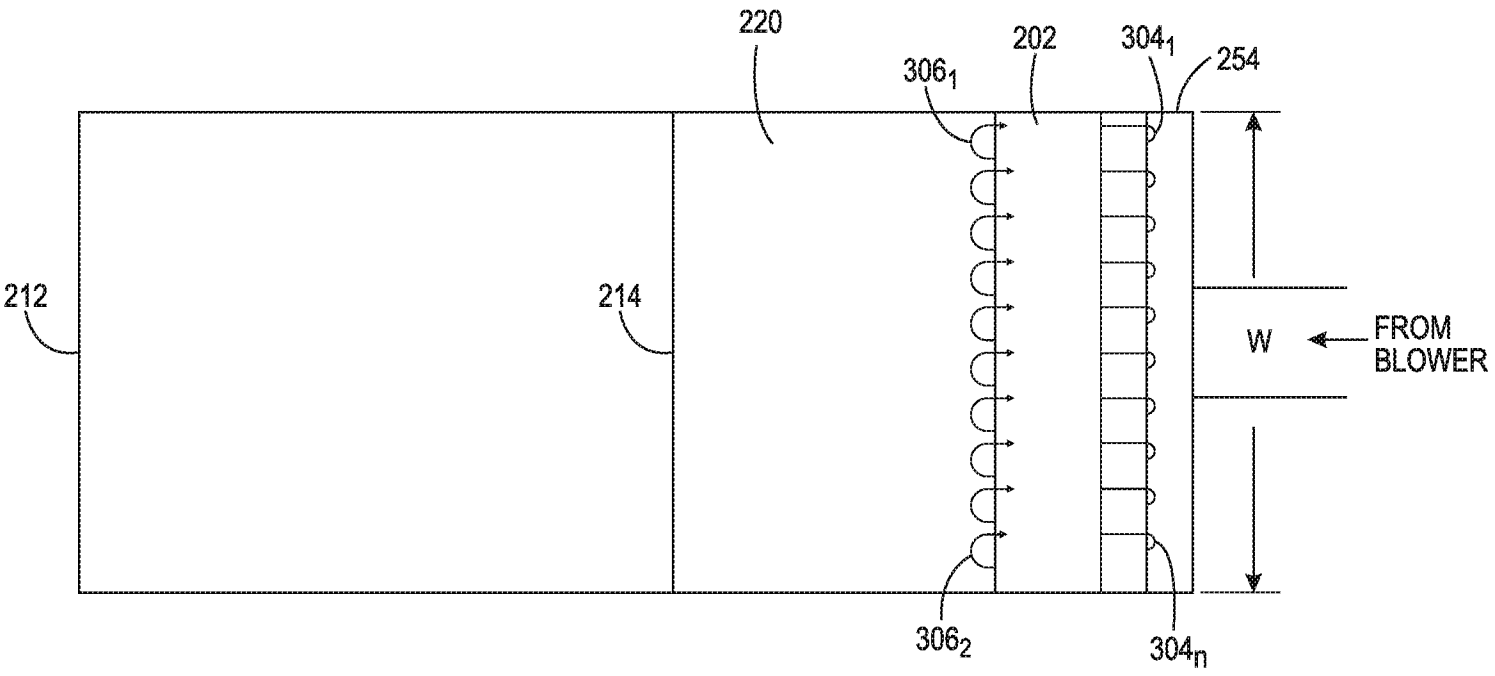
FIG. 3 illustrates a block diagram of a top view of the example stacker module with air streams of the present disclosure.

FIG. 3 illustrates a block diagram of a top view of the stacker module 108. The top view illustrates the movable platform 212, the curved baffle 202, and the air duct 254. In one embodiment, air duct 254 may be an air knife, as discussed above, with a plurality of holes or openings $\mathbf{304}_1$-$\mathbf{304}_n$ (hereinafter also referred to individually as a hole 304 or collectively as holes 304).

As discussed above, the size of the holes 304 may be based on a desired amount of air pressure or velocity of the air flow that is ejected through the holes 304. In one embodiment, the holes 304 may be located approximately along a single line across a width of the air duct 254. The air duct 254 may have a width that is approximately equal to the width of the single sheet 214. In one embodiment, the holes 304 may each have approximately the same diameter. The holes 304 may be evenly, or symmetrically, spaced apart across the width (e.g., the dimension "w" illustrated in FIG. 3) of the air duct 254.

FIG. 3 illustrates how the air flow ejected through the holes 304 flows below the curved baffle 202 and follows the shape of the curved baffle 202, as shown by arrows $\mathbf{306}_1$ to $\mathbf{306}_n$ (hereinafter also referred to individually as an arrow 306 or collectively as arrows 306). In other words, rather than blow straight (e.g., across the page), the air flows below the curved baffle 202 and up and around the curved baffle 202.

Figure 4:
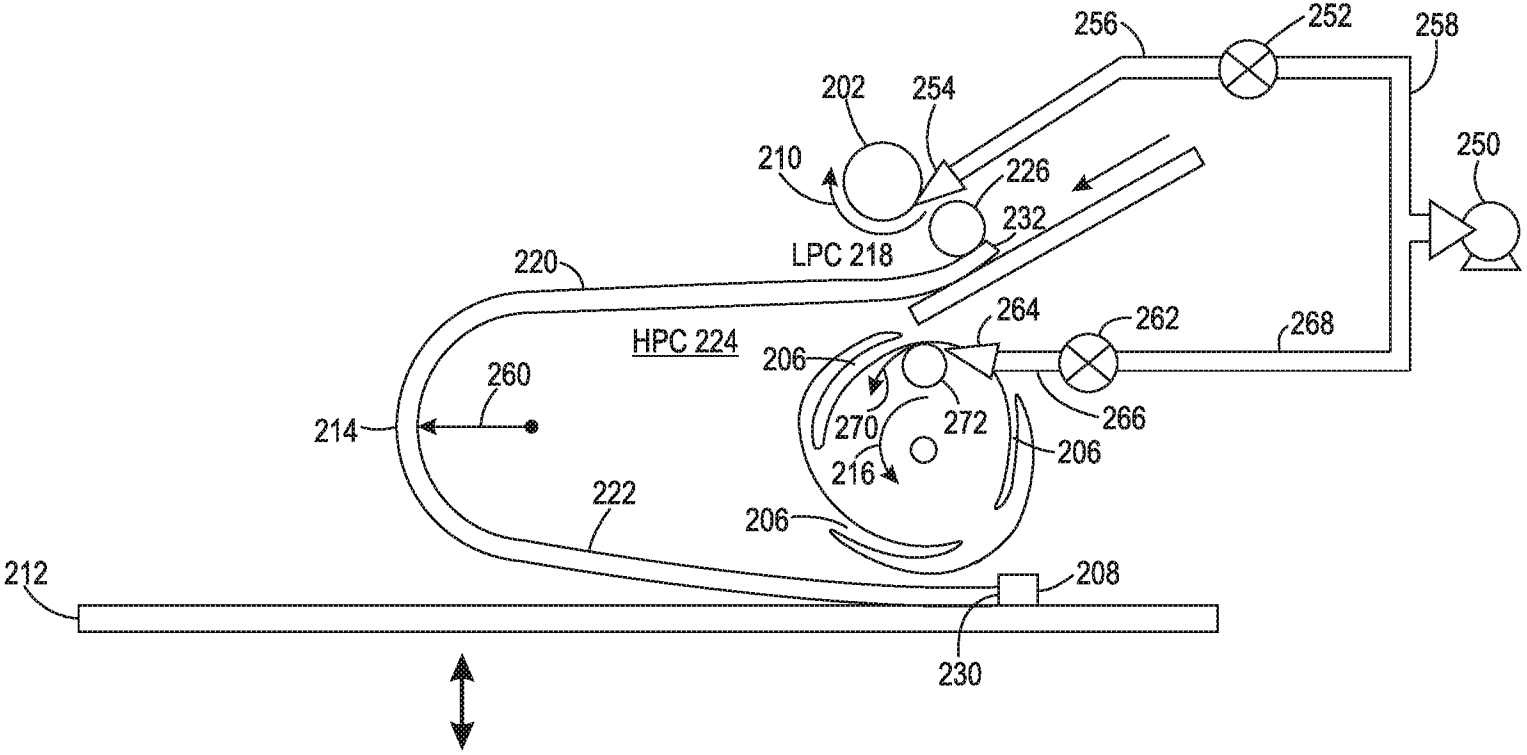
FIG. 4 illustrates a block diagram of a side view of an example stacker module with multiple air streams of the present disclosure.

FIG. 4 illustrates a block diagram of a second example of the stacker module 108 with multiple air streams. In one embodiment, the stacking module 108 may also include a second air duct 264. The second air duct 264 may be located between the plurality of rotating discs 204. The second air duct 254 may be deployed as a single manifold with protruding sections that are located between the plurality of rotating discs 204 or separate sections that are piped between the plurality of rotating discs 204.

In one embodiment, the second air duct 264 may be coupled to a second valve 262 via an air flow coupling 266 (e.g., a pipe or a series of pipes). The second valve 262 may be coupled to the blower 250 via a "T" and an air flow coupling 268 (e.g., a pipe or a series of pipes). In one embodiment, the second valve 262 may be coupled to a separate blower.

In one embodiment, the second valve 262 may also be an electro-mechanical valve that may be actuated by the controller 280. The second valve 262 may control the air flow that exits the air duct 264.

In one embodiment, a second curved baffle 272 may be located adjacent to the second air duct 264. For example, each portion of the second air duct 264 between the plurality of rotating discs 204 may have a respective second curved baffle 272.

As discussed in further details below, the second air duct 264 may help pull the single sheet 214 towards the plurality of rotating discs 204. For example, the second air duct 264 may be operated in an alternating fashion with the air duct 254. For example, the second air duct 264 may be activated first when the leading edge 230 is fed into the stacker module 108. The second air duct 264 may eject an air streams towards the second curved baffle 272 at a high velocity. The air streams may move around the second curved baffle 272 as shown by an arrow 270.

Similar to the air flow from the air duct 254, the air streams from the second air duct 264 may create a low pressure zone below the portion 220 and a high pressure zone above the portion 220. As result, the single sheet 214 may be pull in towards the plurality of rotating discus 204.

In one embodiment, the controller 280 or processor in the DFE 102 may be in communication with the paper feed 226, the plurality of discs 204, the registration wall 208, the blower 250, the valve 252, the movable platform 212, and the second valve 262. Thus, the controller 280 may coordinate operation of the paper feed 226, the plurality of discs 204, the registration wall 208, the blower 250, the valve 252, the movable platform 212, and the second valve 262 to perform the flipping process and stacking process.

For example, when a leading edge 230 of the single sheet 214 enters the stacker module 108, the controller 280 may activate the blower 250 and open the second valve 262. The valve 252 may remain closed. Air from the blower may be ejected out of the second air duct 264 to force an air stream across the second curved baffle 272. The air stream across the curved baffle 272 may pull the single sheet 214 towards the plurality of rotating discs 204 as the discs are rotating.

When the leading edge 230 is determined to contact the registration wall 208 (e.g., by the calculations based on a distance to a sensor in the paper path described above), the registration wall 208 may send a signal to the controller 280. In response, the controller 280 may activate the valve 252 to an open position to allow air flow generated by the blower 250 to move through the valve 252. In addition, the controller 280 may close the second valve 262 to stop the air flow through the air duct 264. As a result, air streams may be ejected out of the air duct 254 and help to maintain a flipping radius 260 of the single sheet 214 during the flipping process, as described above. After the single sheet 214 is flipped (e.g., based on the calculation to determine when the trailing edge 232 leaves the paper feed 226 of the stacker module 108), the controller 280 may control the valve 252 into a closed position for the cycle. The cycle may then be repeated for each subsequent sheet of print media that is fed into the stacker module 108.

In some embodiments, a user may enter the length and weight of the print media that is being used before printing. Based on the length and the weight of the print media, the controller 280 may determine whether operation of the blower 250 is necessary. In some instances, thresholds may be stored in memory to determine automatically when the valves 252 and 262 should be operated. For example, if the length and weight of the print media is above a length threshold and/or a weight threshold, the controller 280 may initiate operation of the blower 250 and control the valves 252 and 262 during the flipping process in the stacker module 108.

Figure 5:
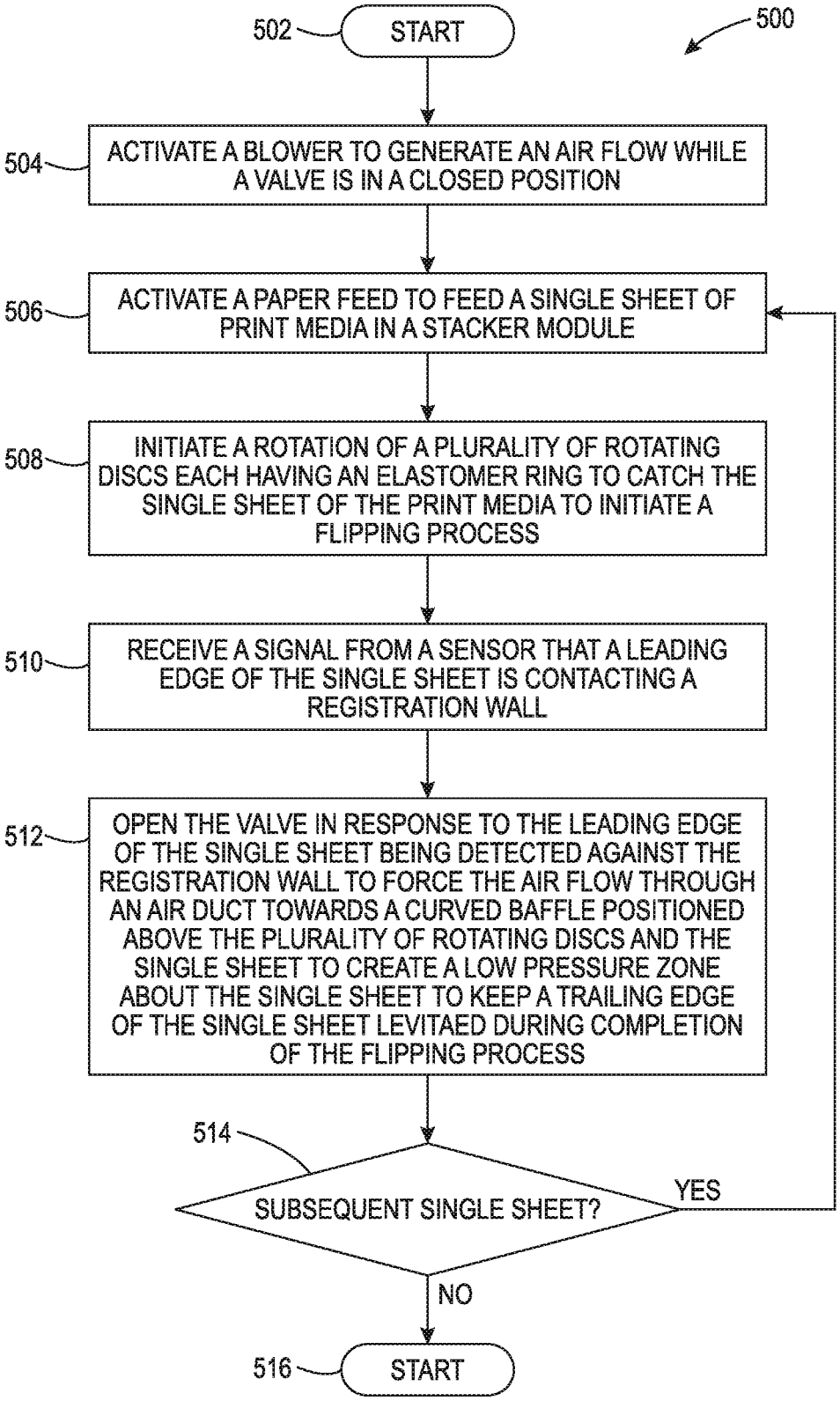
FIG. 5 illustrates a flowchart of an example method for flipping print media in a stacker module.
Figure 6:
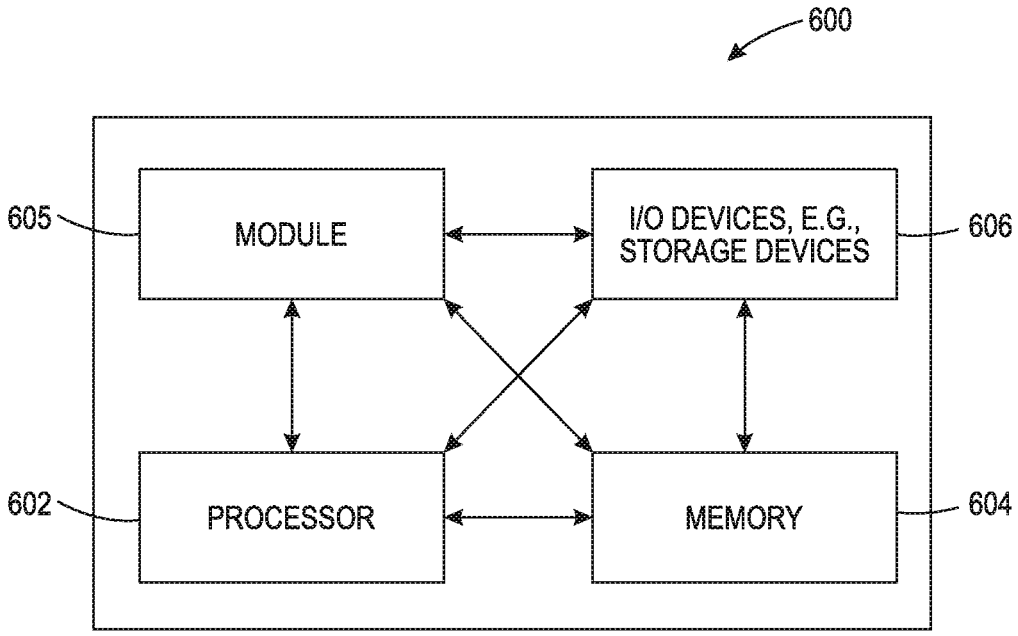
FIG. 6 illustrates a high-level block diagram of an example computer suitable for use in performing the functions described herein.

FIG. 5 illustrates a flowchart of an example method 500 for flipping print media in a stacker module. In one embodiment, one or more steps or operations of the method 500 may be performed by the stacker module 108 or a computer/processor that controls operation of the stacker module 108 as illustrated in FIG. 6 and discussed below.

At block 502, the method 500 begins. At block 504, the method 500 activates a blower to generate an air flow while a valve is in a closed position. For example, a stacking operation may be initiated in the stacker module and the blower may be turned on during a cycle up. The valve may be kept in a closed position until air flow is desired to assist in flipping the single sheet of print media in the stack module.

At block 506, the method 500 activates a paper feed to feed a single sheet of print media in a stacker module. For example, the paper feed may push the single sheet of print media down towards the stacker module to load the print media.

At block 508, the method 500 initiates a rotation of a plurality of rotating discs each having an elastomer ring to catch the single sheet of the print media to initiate a flipping process. The elastomer ring may line a slot or opening along an outer circumference of the plurality of rotating discs. For example, as the single sheet of print media is loaded into the stacker module, the elastomer ring may help catch a leading edge of the single sheet of print media into the slot of each disc. The plurality of rotating discs may then pull the leading edge towards a registration wall.

In one embodiment, an air duct and respective curved baffle located between the plurality of rotating discs may be used to help pull the print media towards the plurality of rotating discs. For example, in response to the initiation of the rotation of the plurality of rotating discs, a second valve coupled to the air duct between the plurality of rotating discs may be opened to allow air flow to be ejected as a high velocity air stream from the air ducts between the plurality of rotating discs. The air streams may move around the respective curved baffle at a high velocity and, due to the Bernoulli effect, pull the paper towards the plurality of rotating discs.

At block 510, the method 500 receives a signal from a sensor that a leading edge of the single sheet is contacting a registration wall. For example, a sensor may be located in or on the registration wall. When the leading edge of the single sheet contacts the sensor on the registration wall, the sensor may transmit a signal to the controller.

In another embodiment, a sensor in the paper path of the stacker module may be used to calculate when the leading edge contacts the registration wall. For example, a distance between the sensor and the registration wall and a speed of the single sheet may be used to calculate when the leading edge of the single sheet contacts the registration wall. When the leading edge contacts the registration wall, the registration wall may signal a processor or controller that the single sheet is in position to begin the flipping process.

At block 512, the method 500 opens the valve in response to the leading edge of the single sheet being detected against the registration wall to force the air flow through an air duct towards a curved baffle positioned above the plurality of rotating discs and the single sheet to create a low pressure zone about the single sheet to keep a trailing edge of the single sheet levitated during completion of the flipping process. For example, the processor or controller may control the valve from a closed position to an open position to allow the air generated by the blower in block 504 to flow out of the air duct. The air flow may exit the air duct and be ejected out of the air duct as an air stream at high velocity towards the curved baffle. The air stream may follow the curved baffle in accordance with the Coanda effect. The air stream may also keep a portion of the single sheet levitated in accordance with the Bernoulli effect created by the high velocity air stream that creates the low pressure zone above a portion closest to the trailing edge of the single sheet. The levitation may assist the single sheet to complete the flipping process without collapsing on itself (e.g., the portion near the trailing edge collapsing on a portion near the leading edge without being completely flipped).

In one embodiment, the second valve coupled to the air duct located between the plurality of rotating discs may be closed in response to the signal from the sensor that the leading edge of the single sheet is contact the registration wall. In other words, the valve coupled to the air duct and the second valve coupled to the air duct located between the plurality of rotating discs can be used in an alternating fashion. For example, the second valve may be opened when the first valve is turned off and vice versa.

In one embodiment, the amount of air flow generated by the blower may be a function of a weight and/or length of the print media that is used. In one embodiment, for a single sheet of print media that has a weight of approximately 45 gsm and a length of 17 inches, the amount of air flow that is generated may be approximately 15-20 cubic feet per minute (cfm).

At block 514, the method 500 determines if there is a subsequent single sheet of print media. For example, if the stacker module has additional sheets of the print media to flip, the answer to block 514 is "yes" and the method returns to block 506. In one embodiment, before returning to block 506, the method 500 may move a movable platform that holds the single sheet lower to receive a subsequent single sheet of the print media. The movable platform may be lowered with each sheet of print media that is flipped and stacked on top of one another. The method 500 may then repeat blocks 506-514 until all of the print media has been flipped and the stacking of the print media is complete.

If the answer to block 514 is "no" then the method may proceed to block 516. At block 516, the method 500 ends. For example, the blower may be deactivated in a cycle down operation until a subsequent request to perform a stacking operation is received.

It should be noted that the blocks in FIG. 5 that recite a determining operation or involve a decision do not necessarily require that both branches of the determining operation be practiced. In other words, one of the branches of the determining operation can be deemed as an optional step. In addition, one or more steps, blocks, functions or operations of the above described method 500 may comprise optional steps, or can be combined, separated, and/or performed in a different order from that described above, without departing from the example embodiments of the present disclosure.

FIG. 6 depicts a high-level block diagram of a computer that is dedicated to perform the functions described herein. As depicted in FIG. 6, the computer 600 comprises one or more hardware processor elements 602 (e.g., a central processing unit (CPU), a microprocessor, or a multi-core processor), a memory 604, e.g., random access memory (RAM) and/or read only memory (ROM), a module 605 for flipping print media in a stacker module, and various input/output devices 606 (e.g., storage devices, including but not limited to, a tape drive, a floppy drive, a hard disk drive or a compact disk drive, a receiver, a transmitter, a speaker, a display, a speech synthesizer, an output port, an input port and a user input device (such as a keyboard, a keypad, a mouse, a microphone and the like)). Although only one processor element is shown, it should be noted that the computer may employ a plurality of processor elements. Furthermore, although only one computer is shown in the figure, if the method(s) as discussed above is implemented in a distributed or parallel manner for a particular illustrative example, i.e., the steps of the above method(s) or the entire method(s) are implemented across multiple or parallel computers, then the computer of this figure is intended to represent each of those multiple computers. Furthermore, one or more hardware processors can be utilized in supporting a virtualized or shared computing environment. The virtualized computing environment may support one or more virtual machines representing computers, servers, or other computing devices. In such virtualized virtual machines, hardware components such as hardware processors and computer-readable storage devices may be virtualized or logically represented.

It should be noted that the present disclosure can be implemented in software and/or in a combination of software and hardware, e.g., using application specific integrated circuits (ASIC), a programmable logic array (PLA), including a field-programmable gate array (FPGA), or a state machine deployed on a hardware device, a computer or any other hardware equivalents, e.g., computer readable instructions pertaining to the method(s) discussed above can be used to configure a hardware processor to perform the steps, functions and/or operations of the above disclosed methods. In one embodiment, instructions and data for the present module or process 605 for flipping print media in a stacker module (e.g., a software program comprising computer-executable instructions) can be loaded into memory 604 and executed by hardware processor element 602 to implement the steps, functions or operations as discussed above in connection with the example method 500. Furthermore, when a hardware processor executes instructions to perform "operations," this could include the hardware processor performing the operations directly and/or facilitating, directing, or cooperating with another hardware device or component (e.g., a co-processor and the like) to perform the operations.

The processor executing the computer readable or software instructions relating to the above described method(s) can be perceived as a programmed processor or a specialized processor. As such, the present module 605 for flipping print media in a stacker module (including associated data structures) of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. More specifically, the computer-readable storage device may comprise any physical devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus, comprising:

a paper feed to feed print media a single sheet at a time;

a plurality of rotating discs, wherein each one of the plurality of rotating discs comprises an elastomer ring to secure a leading edge of the single sheet against a registration wall and initiate a flipping process;

a curved baffle positioned above the plurality of rotating discs and the single sheet;

a first air duct located above the plurality of rotating discs and the single sheet to force an air flow towards the curved baffle, wherein the air flow follows a shape of the curved baffle to create a low pressure zone above the single sheet to keep a trailing edge of the single sheet levitated during completion of the flipping process;

a movable platform to hold a stack of the print media;

a plurality of second air ducts located between the plurality of rotating discs; and a respective curved baffle located adjacent to each one of the plurality of second air ducts located between the plurality of rotating discs.

2. The apparatus of claim 1, wherein the first air duct further comprises:

a blower to generate the air flow; and a valve coupled to the blower and the first air duct to control the air flow.

3. The apparatus of claim 2, further comprising:

a sensor to detect when the single sheet contacts the registration wall during the flipping process.

4. The apparatus of claim 3, wherein the valve opens in response to a detection signal generated by the registration wall to allow the air flow to be forced through the first air duct.

5. The apparatus of claim 3, wherein the valve closes when a detection signal is not generated by the registration wall to prevent the air flow from being forced through the first air duct.

6. The apparatus of claim 1, wherein the first air duct comprises an air knife.

7. The apparatus of claim 1, wherein an amount of the air flow comprises approximately 15-20 cubic feet per minute (cfm).

8. The apparatus of claim 1, wherein a second air flow through the plurality of second air ducts causes the single sheet to move towards the plurality of rotating discs.

9. The apparatus of claim 1, wherein the print media comprises paper having a weight of less than 50 grams per square meter (gsm) and a length of less than 20 inches.

10. A method for flipping print media in a stacker module, comprising:

activating, by a processor, a blower to generate an air flow while a valve is in a closed position;

activating, by the processor, a paper feed to feed a single sheet of the print media in a stacker module;

initiating, by the processor, a rotation of a plurality of rotating discs each having an elastomer ring to catch the single sheet of the print media to initiate a flipping process;

receiving, by the processor, a signal from a sensor that a leading edge of the single sheet is contacting a registration wall;

opening, by the processor, the valve in response to the leading edge of the single sheet being detected against the registration wall to force the air flow through an air duct towards a curved baffle positioned above the plurality of rotating discs and the single sheet to create a low pressure zone about the single sheet to keep a trailing edge of the single sheet levitated during completion of the flipping process; and opening, by the processor, a second valve in response to the initiating the rotation of the plurality of rotating discs to force air flow through a second air duct located between the plurality of rotating discs and towards a second curved baffle to pull the single sheet towards the plurality of rotating discs.

11. The method of claim 10, further comprising:

detecting, by the processor, that the trailing edge has exited a paper feed; and closing, by the processor, the valve to prevent the air flow through the air duct.

12. The method of claim 11, further comprising:

moving, by the processor, a movable platform that holds the single sheet lower to receive a subsequent single sheet of the print media; and repeating, by the processor, the activating the paper feed, the initiating the rotation, the receiving a signal from the sensor that the leading edge of the single sheet is against the registration wall, the opening the valve, the detecting that the trailing edge has exited the paper feed, and the closing the valve for the subsequent single sheet of print media until stacking of the print media is complete.

13. The method of claim 10, wherein the opening the second valve is performed before the opening of the valve in response to the leading edge of the single sheet being detected against the registration wall.

14. The method of claim 10, further comprising:

closing, by the processor, the second valve after the receiving the signal from the sensor that the leading edge of the single sheet is contacting the registration wall.

15. The method of claim 10, wherein an amount of the air flow through the air duct and the second air duct is a function of a weight and a length of the single sheet of the print media.

16. The method of claim 15, wherein an amount of the air flow through the air duct and the second air duct comprises a range of approximately 15-20 cubic feet per minute (cfm).

17. The method of claim 15, wherein the weight comprises less than 50 grams per square meter (gsm) and the length comprises less than 20 inches.

18. An apparatus, comprising:

a paper feed to feed a single sheet of paper at a time, wherein the paper weighs less than 50 grams per square meter (gsm) and has a length of at least 19 inches;

a plurality of rotating discs, wherein each one of the plurality of rotating discs comprises an elastomer ring, wherein the plurality of rotating discs rotate approximately 180 degrees to secure a leading edge of the single sheet against a registration wall and initiate a flipping process as the single sheet is fed through the paper feed;

a blower to generate an air flow;

a first curved baffle located between the plurality of rotating discs;

a first air duct located between the plurality of rotating discs;

a first valve coupled downstream of the blower to control a first portion of the air flow through the first air duct in response to initiation of rotation of the plurality of rotating discs to pull the single sheet towards the plurality of rotating discs;

a second curved baffle positioned above the plurality of rotating discs and the single sheet;

a second air duct located above the plurality of rotating discs and the single sheet; and a second valve coupled downstream of the blower to control a second portion of the air flow through the second air duct in response to the leading edge contacting the registration wall, wherein the second portion of the air flow creates a low pressure zone above the single sheet to keep a trailing edge of the single sheet levitated during completion of the flipping process.

* * * * *